US007506972B2

(12) United States Patent
Aruga

(10) Patent No.: US 7,506,972 B2
(45) Date of Patent: Mar. 24, 2009

(54) INK CARTRIDGE

(75) Inventor: Yoshiharu Aruga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 336 days.

(21) Appl. No.: 11/443,128

(22) Filed: May 31, 2006

(65) Prior Publication Data

US 2006/0232648 A1 Oct. 19, 2006

Related U.S. Application Data

(62) Division of application No. 10/466,180, filed as application No. PCT/JP02/11649 on Nov. 8, 2002, now Pat. No. 7,086,722.

(30) Foreign Application Priority Data

Nov. 12, 2001 (JP) ..... P2001-345828

(51) Int. Cl.
*B41J 2/175* (2006.01)

(52) U.S. Cl. ..... 347/86

(58) Field of Classification Search ..... 347/84, 347/85, 86, 87; 141/2, 18
See application file for complete search history.

(56) References Cited

U.S. PATENT DOCUMENTS

| | | | | |
|---|---|---|---|---|
| 4,558,326 | A | 12/1985 | Kimura et al. | |
| 4,598,303 | A | 7/1986 | Peekema et al. | |
| 4,604,633 | A * | 8/1986 | Kimura et al. | 347/7 |
| 4,977,413 | A * | 12/1990 | Yamanaka et al. | 347/7 |
| 5,526,030 | A | 6/1996 | Baldwin et al. | |
| 5,917,523 | A | 6/1999 | Baldwin et al. | |
| 6,000,788 | A | 12/1999 | Iida | |
| 6,116,723 | A | 9/2000 | Childers | |
| 6,186,620 | B1 | 2/2001 | Hsieh et al. | |
| 6,264,314 | B1 | 7/2001 | Mochizuki et al. | |
| 6,352,324 | B1 | 3/2002 | Pagnon et al. | |
| 6,494,568 | B2 | 12/2002 | Hou et al. | |

(Continued)

FOREIGN PATENT DOCUMENTS

CN 1218742 A 6/1999

(Continued)

OTHER PUBLICATIONS

Japanese Office Action for Japanese Patent Application 2003-543826.

*Primary Examiner*—Anh T. N. Vo
(74) *Attorney, Agent, or Firm*—Sughrue Mion, PLLC

(57) ABSTRACT

An ink cartridge includes an ink pack 21 which discharges ink from an ink outlet 22 upon reception of pressure by air pressure; an outer case 20*a*, 20*b* which houses the ink pack 21 therein with the ink outlet 22 exposed so that the ink pack 21 can be pressurized by the air pressure, and includes a pressurized air inlet 23 that is connectable to an air source for pressurizing the ink pack 21; and a pressure adjusting unit 30 which is housed in the outer case and discharges air in the outer case to the outside so that pressure in space of the outer case is kept at a setting value. The setting value of the pressure adjusting unit 30 is set to an optimum value for each ink cartridge, whereby the ink pack can be pressurized in an optimum state regardless of the air pressure from the pressurized air inlet 23.

5 Claims, 11 Drawing Sheets

U.S. PATENT DOCUMENTS

| | | | | |
|---|---|---|---|---|
| 6,511,168 | B2 | 1/2003 | Higuma | |
| 6,666,552 | B2 | 12/2003 | Anderson et al. | |
| 7,086,722 | B2 * | 8/2006 | Aruga | 347/86 |
| 2001/0038405 | A1 | 11/2001 | Ishiawa et al. | |

FOREIGN PATENT DOCUMENTS

| | | | |
|---|---|---|---|
| EP | 519664 | A2 | 12/1992 |
| EP | 564069 | A2 | 1/1993 |
| EP | 562717 | A1 | 9/1993 |
| EP | 0 968 831 | A1 | 1/2001 |
| EP | 1 097814 | A2 | 5/2001 |
| EP | 1 142 713 | A2 | 10/2001 |
| EP | 0 562 717 | A1 | 9/2003 |
| JP | S59-45160 | A | 3/1984 |
| JP | 60-198256 | | 10/1985 |
| JP | H05-229137 | A | 9/1993 |
| JP | H09-123476 | A | 5/1997 |
| JP | H09-150524 | A | 6/1997 |
| JP | 2994740 | B2 | 10/1999 |
| JP | 2001-162834 | | 6/2001 |
| JP | 2001-199080 | A | 7/2001 |
| JP | 2001-205819 | A | 7/2001 |
| JP | 2001-212974 | A | 8/2001 |
| JP | 2002-001978 | | 1/2002 |
| JP | 2002-502334 | A | 1/2002 |
| JP | 2002-510253 | A | 4/2002 |
| WO | WO98/55319 | | 12/1998 |
| WO | WO98/55322 | A1 | 12/1998 |

* cited by examiner

INK CARTRIDGE

This is a divisional of application Ser. No. 10/466,180 filed Jul. 19, 2004, now U.S. Pat. No. 7,086,722 which is a National Stage Entry Application of PCT Application No. PCT/JP02/11649 filed Nov. 8, 2002. The entire disclosures of the prior applications, application Ser. Nos. 10/466,180 and PCT/JP02/11649 are considered part of the disclosure of the accompanying divisional application and are hereby incorporated by reference.

TECHNICAL FIELD

The invention relates to an ink cartridge in which pressurized air is applied into an air chamber between an outer case and an ink pack thereby to discharge ink from the ink pack.

RELATED ART

Generally, an ink jet recording apparatus for business use is constructed so that a large-volume ink cartridge is exchangeably set in a body of the recording apparatus and ink is supplied through an ink supply tube to a recording head mounted on a carriage directly, or through a sub-tank, as shown in Japanese Patent Publication JP-A-2001-199080 for example.

Further, the ink cartridge is so constructed that a deformable ink pack under external pressure is housed in an outer case which can hold air-tightness, exposing only an ink outlet of the ink pack. Pressurized air is supplied to the outer case from an air source for pressure in which the air pressure is adjusted at a constant pressure in advance, and the ink pack is pressurized by the air pressure thereby to supply ink to the recording head.

In such the construction, even if the air pressure in the air source for pressure is appropriately adjusted, unevenness in ink supply capacity is raised among the respective ink cartridges to the recording head, thereby causing a problem of deterioration in printing quality, in case that unevenness in flowing passage resistance is raised by differences in length of ink supply tubes connecting the respective ink cartridges and the recording head, or the sub-tanks, or in case that head differences are produced between the ink cartridges by arranging the ink cartridges vertically.

Therefore, an object of the present invention is to provide an ink cartridge having a pressure adjusting function with which the air force for pressurizing an ink pack can be set independently in the respective ink cartridges without depending on the air pressure supplied from the air source for pressure.

Another object of the invention is to provide an ink cartridge in which the ink pack can be pressurized so that ink discharging amount is suitable for printing regardless of ink remaining amount.

DISCLOSURE OF THE INVENTION

In order to achieve such the objects, the invention comprises an ink pack which discharges ink from an ink outlet upon reception of pressure by air pressure; an outer case which houses the ink pack therein with the ink outlet exposed so that the ink pack is pressurized by the air pressure, and includes a pressurized air inlet that is connectable to an air source for pressurizing the ink pack; and a pressure adjusting unit which is housed in the outer case and discharges air in the outer case to the outside so that pressure in space of the outer case is kept at a setting value.

According to the invention, the setting value of the pressure adjusting unit can be set to an optimum value for each ink cartridge, and the ink pack can be pressurized in an optimum state regardless of air pressure provided from the pressurized air inlet, namely, the pressure of the air source for pressure.

Further, in the invention, the pressure adjusting unit comprises an urging unit for adjusting the setting value; an elastic pressure reception plate which is displaced when one surface is pressed by the urging unit, and when the other surface receives the pressure in the space of the outer case; and an air communicating hole forming member which communicates to the atmosphere and is sealed by the elastic pressure reception plate.

According to the invention, the pressure adjusting unit can be made as small as possible, and a general-purpose differential pressure valve can be applied.

Further, in the invention, the pressurized air inlet is arranged in a position opposed to the elastic member, and communicated with the space of the outer case through a flowing passage resistance forming portion.

According to the invention, even in case that excessive pressure is applied from the pressurized air inlet, it can be released to the atmosphere by the displacement of the elastic member so to lower the excessive pressure.

Further, in the invention, the setting value is individually set according to ink capacity of the ink cartridge.

Hereby, even if cartridges are different in size or in viscosity of ink, ink can be supplied to the recording head in an optimum state.

Further, in the invention, the urging unit is provided with a unit which changes its urging force according to the ink remaining amount of the ink pack.

Hereby, regardless of ink remaining amount, ink discharging amount suitable for printing can be supplied to the recording head.

Further, in the invention, the pressure adjusting unit comprises a deformation region which is formed at a partial region of the outer case and is elastically deformable by the air pressure; and a valve member which opens or closes according to displacement of the deformation region thereby to communicate the space in the outer case with the atmosphere.

According to the invention, the structure can be simplified, the setting value of the pressure adjusting unit can be set to an optimum value for each ink cartridge, and the ink pack can be pressurized in an optimum state regardless of air pressure from the pressurized air inlet.

Further, in the invention, the valve member is arranged so that the urging unit seals the air-communicating hole formed at the deformation region, and an operating rod for pressing the valve member is exposed from the air-communicating hole.

According to the invention, dead space of the ink cartridge can be utilized effectively, and a position for providing the deformation region can be selected more freely.

BRIEF DESCRIPTION OF THE DRAWINGS

FIGS. 4A and 4B are sectional views in the direction of an arrow from a line of A-A in FIG. 3, in which FIG. 4A shows a state where a pressure adjuster valve is closed, and FIG. 4B shows a state where it is opened.

FIGS. 11A and 11B are diagrams showing one embodiment of a sub-tank constituting the recording apparatus of the invention in section taken along a line of B-B of FIG. 12A, in which FIG. 11A shows a state where ink is supplied to a recording head, and FIG. 11B shows a state where ink supply is stopped.

PREFERRED EMBODIMENTS OF THE INVENTION

Figure 1:
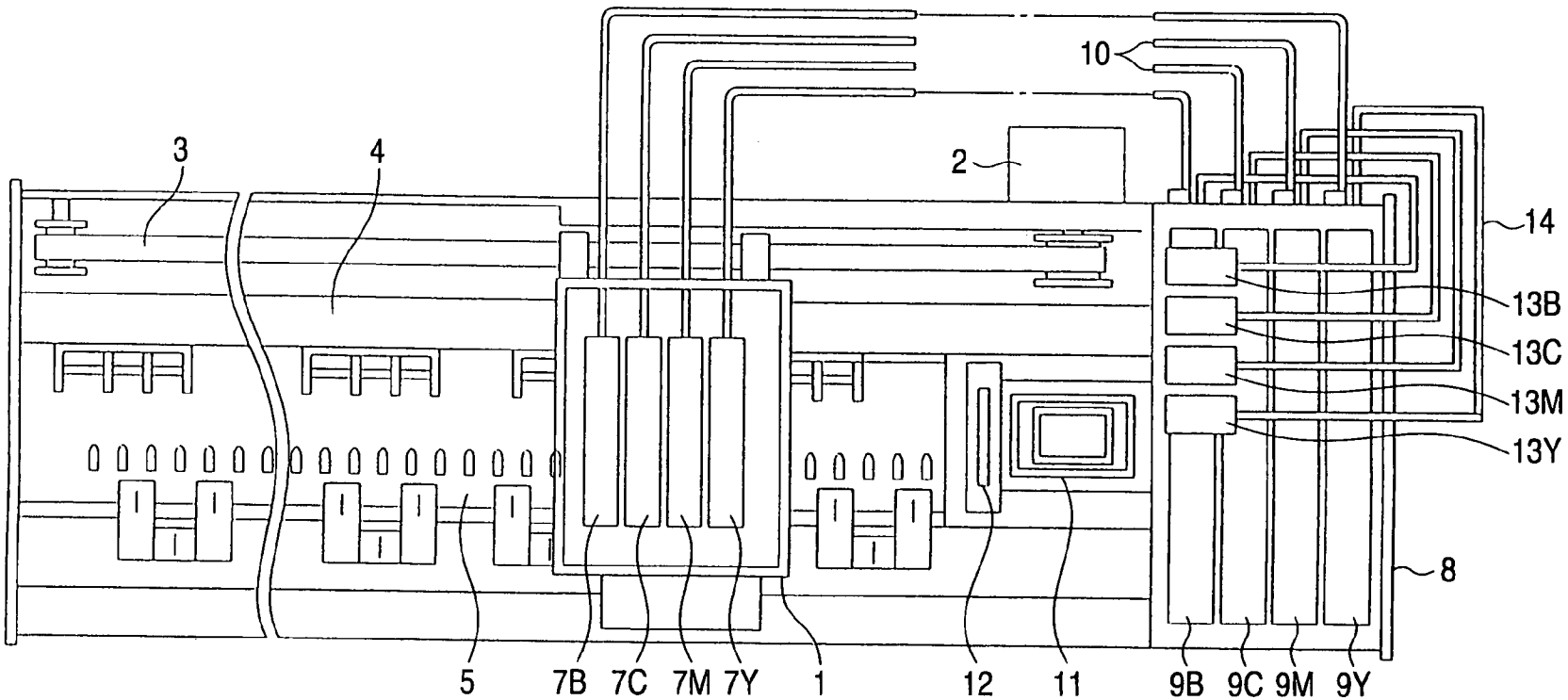
FIG. 1 is a plan view showing one example of an ink jet recording apparatus in which an ink cartridge of the invention is used.
Figure 2:
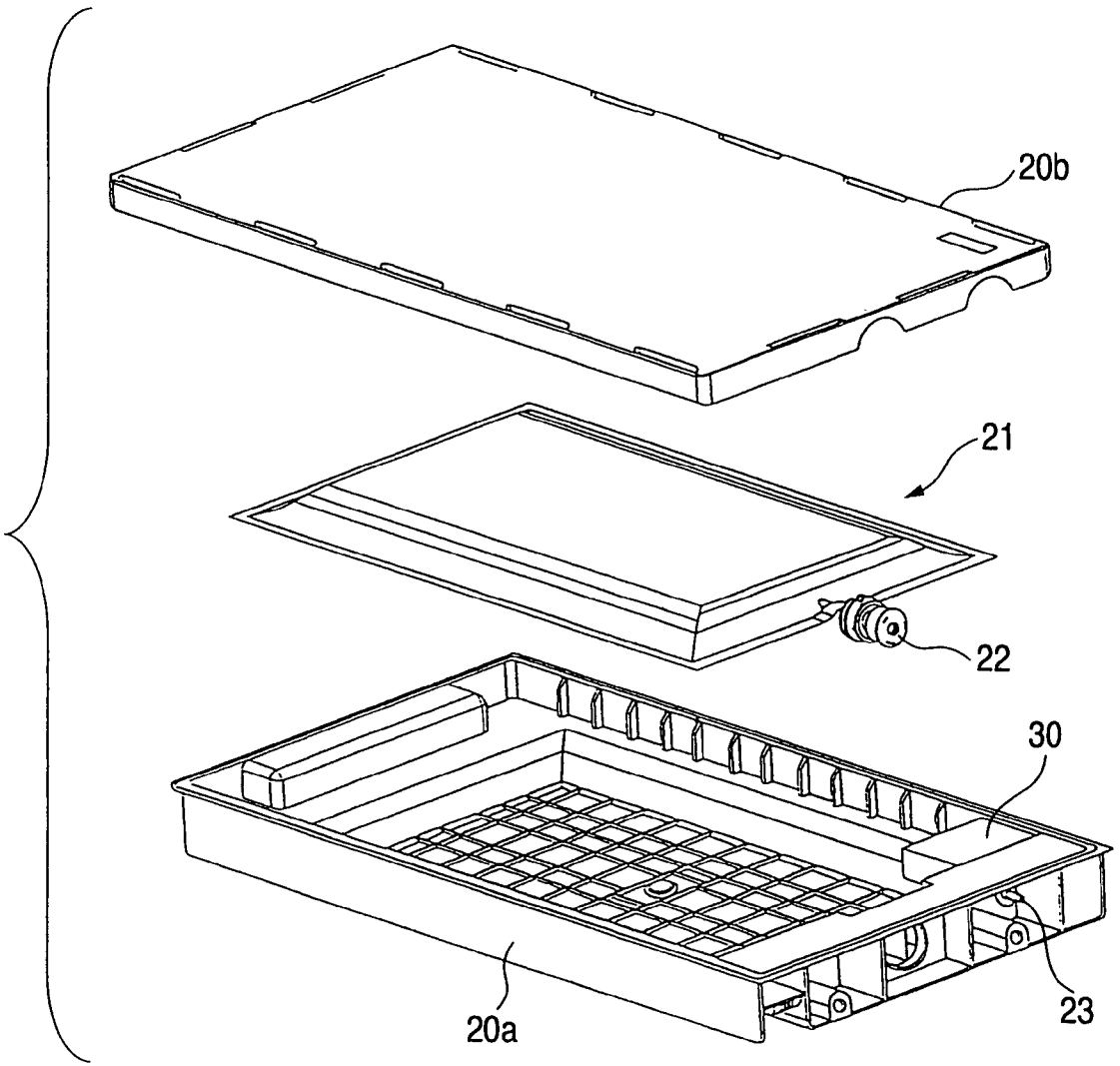
FIG. 2 is a perspective view in assembly showing one embodiment of the ink cartridge of the invention.
Figure 3:
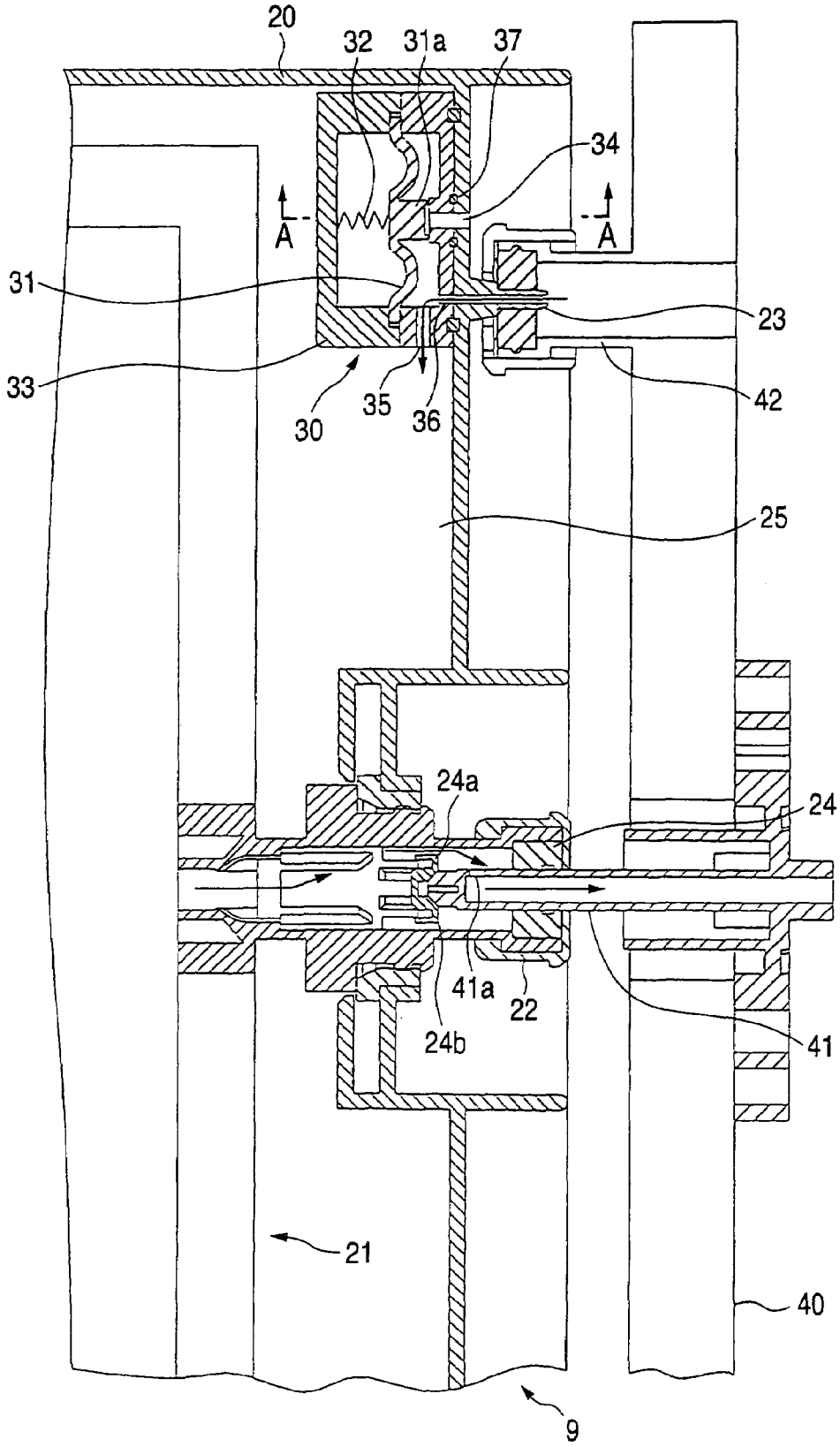
FIG. 3 is a sectional view showing the structure of the ink cartridge in a flowing passage forming portion.
Figure 4A:
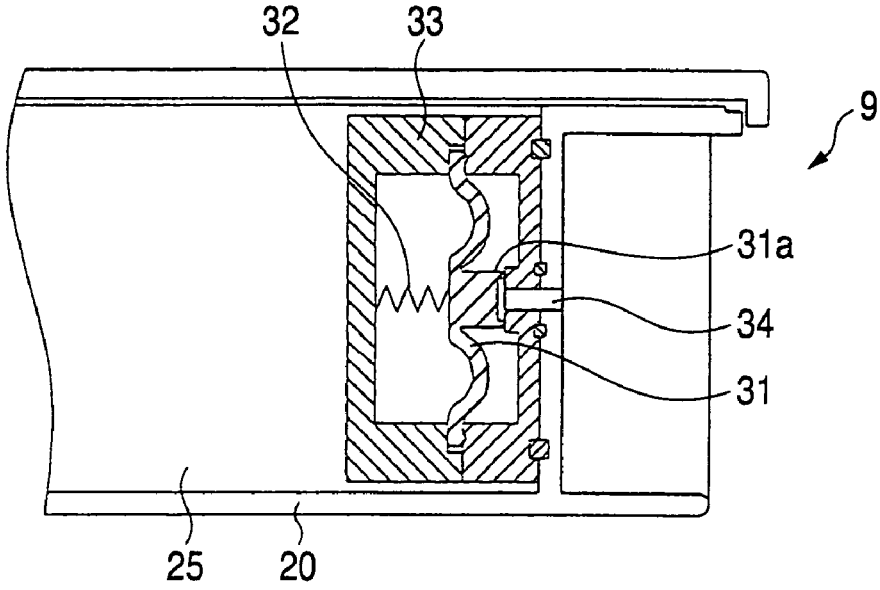
Figure 4B:
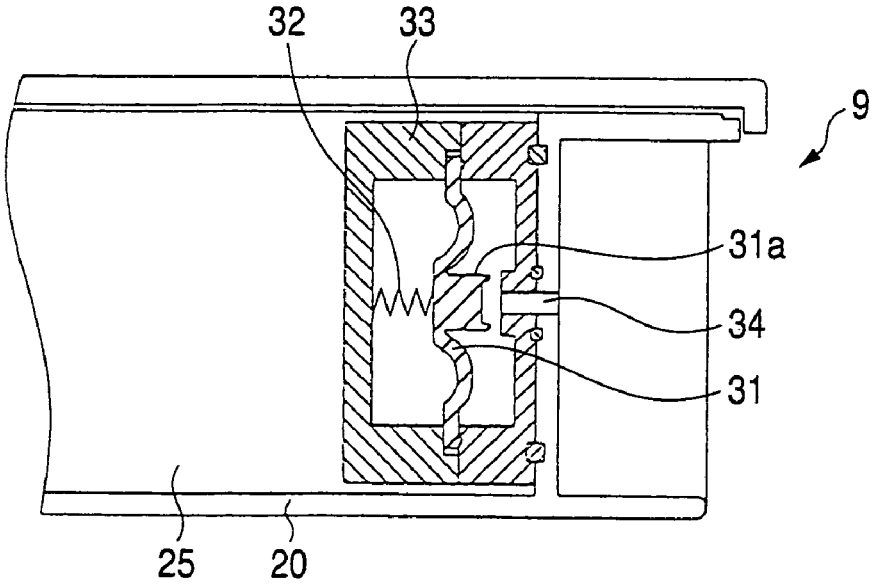

FIG. 1 shows one embodiment of an ink jet recording apparatus of the invention, in which a carriage 1 is guided by a scan guide member 4 through a timing belt 3 driven by a carriage motor 2 in a longitudinal direction of a sheet feeding member 5, that is, in a main scanning direction that is a width direction of a recording sheet. On a surface of the carriage 1 opposed to the sheet feeding member 5, that is, on a lower surface of the carriage 1 in this embodiment, a not-shown ink jet recording head which can eject ink of each color as a liquid droplet is provided. Further, on the upper surface of the carriage 1, sub-tanks 7B, 7C, 7M, 7Y for supplying ink to the recording head are mounted.

On one side of a frame 8, ink cartridges 9B, 9C, 9M, 9Y are detachably arranged. The ink cartridges 9B, 9C, 9M, 9Y are respectively connected through tubes 10 to the sub-tanks 7B, 7C, 7M, 7Y, and supply ink to the recording head through the respective sub-tanks 7B, 7C, 7M, 7Y. The respective ink cartridges 9B, 9C, 9M, 9Y are connected at space of their outer cases to respective individual air pump 13B, 13C, 13M, and 13Y to by tubes 14; whereby ink is discharged to the sub-tanks by pressurized force of pressurized air.

At a non-printing region on a moving passage of the carriage 1, a capping unit 11 which can seal a nozzle-forming surface of the recording head, and a wiping member 12 which is adjacent to the capping unit 11 and made of elastic material such as rubber are arranged.

FIGS. 2 to 4B show one embodiment of the ink cartridge. The ink cartridge comprises an outer case 20 and an ink pack 21, and the ink pack 21 is housed in the outer case 20 so that an ink outlet pipe 22 provided for the ink pack 21 is exposed from a center portion of one side surface of the case 20. The outer case 20 comprises a container body 20*a* and a lid member 20*b*, and includes a pressurized air inlet 23 for taking in the pressurized air at an end region of one side surface where the ink outlet pipe 22 is exposed.

The ink pack 21, as known, is made of liquid-tight film which can deform upon reception of air pressure of the pressurized air, and stores ink therein. Further, a cylindrical stopper 24 having a permeable pore is attached to a leading end of the ink outlet pipe 22 in order to liquid-tightly come into contact with the periphery of an ink inlet pipe 41.

The pressurized air inlet 23 is connected to a space 25 of the outer case 20 through a pressure adjusting unit 30, and an air inlet passage is constituted so that air pressure suitable to discharge ink from the ink pack 21 is applied to the ink pack 21.

The pressure adjusting unit 30 is so constructed that an elastic pressure reception plate 31 formed of elastic material such as rubber having air-tightness and elasticity, namely, a diaphragm in this embodiment for example, are housed in an air communicating hole forming member 33, namely, a case in this embodiment so that a constant pressure is applied onto one surface of the elastic pressure reception plate 31 by an elasticity applying unit 32 such as a spring. Further, the pressure adjusting unit 30 is so constructed that an air communicating hole 34 is formed in a position of the air communicating hole forming member 33 opposed to a center region of the elastic pressure reception plate 31, and that a communicating hole 35 is formed on a side of the air communicating hole forming member 33 so as to communicate with the space 25 of the outer case. In this embodiment, a permeable pore 36 is formed in a position of the air-communicating hole forming member 33 opposed to the pressurized air inlet 23.

Further, it is clear that the similar effect is obtained even if the pressurized air inlet 23 is formed at the end surface where the ink outlet pipe 22 is exposed and in a position asymmetric with the pressure adjusting unit 30.

The elastic pressure reception plate 31 has a convex portion 31*a* at its region opposed to the air-communicating hole 34, and the convex portion 31*a* seals the air-communicating hole 34 surely. Reference numeral 37 represents a packing for securing air-tightness between the air-communicating hole forming member 33 and the outer case 20.

On the other hand, a cartridge holder is provided, and it includes an ink inlet pipe 41 formed fittably to the ink outlet pipe 22 of the ink cartridge on its wall surface 40 opposed to the ink outlet pipe 22 of the ink cartridge 9, and a pressurized air outlet pipe 42 arranged fittably to the pressurized air inlet 23. The ink inlet pipe 41 is connected to each sub-tank 7B, 7C, 7M, and 7Y through the tube passage 10, and the pressurized air outlet pipe 42 is connected to an discharge port of each air pump 13B, 13C, 13M, 13Y (FIG. 1).

In this embodiment, when the ink cartridge 9 is attached into the holder, the ink outlet pipe 22 of the ink cartridge 9 firstly fits to the ink inlet pipe 41 on the recording apparatus side, and then the pressurized air inlet 23 of the ink cartridge 9 fits to the pressurized air inlet pipe 42 air-tightly. Hereby, without causing ink leakage from the cartridge 1, attachment of the ink cartridge 9 is completed.

When the attachment of the ink cartridge 9 is detected by a not-shown cartridge attachment detecting unit, the air pumps 13B, 13C, 13M, and 13Y operate and the pressurized air flow through the pressurized air inlet 23 and the permeable pore 36 in the space 25 of the outer case 20.

In this embodiment, the pressurized air flows in the space of the outer case 20 through the communicating hole 35 of the air-communicating hole forming member 33 constituting the pressure adjusting unit 30. Therefore, when the fluid resistance of the communicating hole 35 is used as a flowing passage resistance forming portion appropriately set, even in case that air of excessive pressure is supplied at the carriage attaching time, the elastic pressure reception plate 31 firstly receives its pressure and retreats thereby to open the air communicating hole 34, relax sharp pressure change of the outer case 20, and prevent the ink pack and the ink supplying passage from receiving the sharp pressure change, so that break can be prevented.

Under the present state, the pressure of the space in the outer case 20 is roughly atmospheric pressure, and the elastic pressure reception plate 31 seals the air communicating hole 34 by the urging force of the urging unit 32. Therefore, all the pressurized air flows in the space 25 of the outer case 20. When the pressure in the space 25 of the outer case 20 thus becomes higher than the pressure suitable to supply ink from the ink pack 21 to the sub-tank, the elastic pressure reception plate 31 retreats from the air-communicating hole 34 against the urging unit 32. Hereby, a part of air in the outer case 20 flows out from the air communicating hole 34 and the pressure in the outer case 20 decreases.

When the pressure in the space 25 of the outer case 20 becomes lower than the pressure suitable to supply ink from the ink pack 21 to the sub-tank, the elastic pressure reception plate 31 is pressed by the urging unit 32 to close the air-communicating hole 34. Sequentially, such the steps are repeated according to the pressure in the space 25 of the outer frame 20, whereby the pressure in the space 25 of the outer frame 20 is kept at the pressure suitable for ink supply.

When the ink cartridge 9 is pulled out from the holder, firstly the pressurized air inlet 23 of the ink cartridge 9 comes out of the pressurized air outlet pipe 42. Therefore, the air in the space 25 of the outer case 20 is released to the atmosphere through the permeable pore 36 from the pressurized air inlet 23, and the pressure in the space 25 decreases up to the atmospheric pressure. Next, the ink outlet pipe 22 of the ink cartridge 9 comes out of the ink inlet pipe 41 of the recording apparatus.

In this embodiment, the stopper 24 of the ink outlet pipe 22 includes a through-hole 24*a* into which the ink inlet pipe 41 can be inserted and which holds the surroundings of the ink inlet pipe 41 air-tightly; and a movable member 24*b* which retreats in this through-hole 24*a* upon reception of press of the ink inlet pipe 41, and usually comes into contact with the through-hole 24*a* by a spring. Further, the ink inlet pipe 41 includes a communicating hole 41*a* at its side portion.

Hereby, in a state where the ink cartridge is not attached into the holder, the movable member 24*b* seals the through-hole 24*a* of the stopper 24, so that leakage of ink and inflow of air into the ink pack 21 can be prevented. Further, in a state where the ink cartridge is attached into the holder, the movable member 24*b* retreats, so that ink flows into the ink inlet pipe 41 from the through-hole 41*a* of the ink inlet pipe 41.

Figure 5:
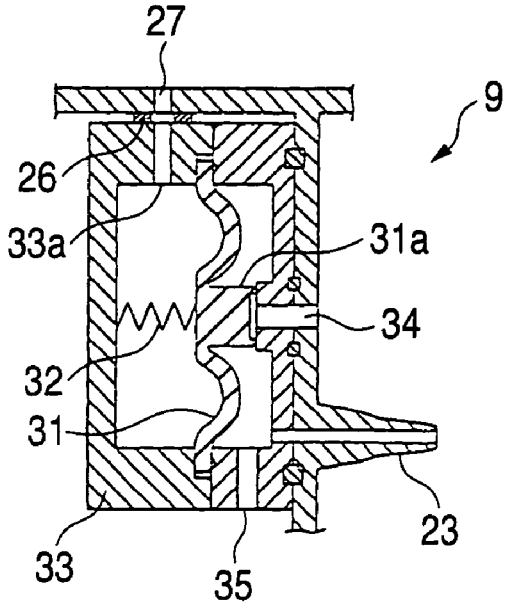
FIGS. 5 and 6 are sectional views showing another embodiment of the pressure adjuster valve provided for the ink cartridge.

In the above-mentioned embodiment, the backside of the elastic pressure reception plate 31 constituting the pressure adjusting unit 30, that is, the space in which the urging unit 32 is housed is sealed. However, as shown in FIG. 5, in case that a permeable pore 33*a* which interrupts the space 25 of the outer case 20 through a packing 26, and communicates with a permeable pore 27 of the outer case 20 to communicate with the atmosphere is provided, the fluctuation of the set pressure of the elastic pressure reception plate 31 caused by increase of temperature can be prevented, so that ink can be stably supplied.

Figure 6:
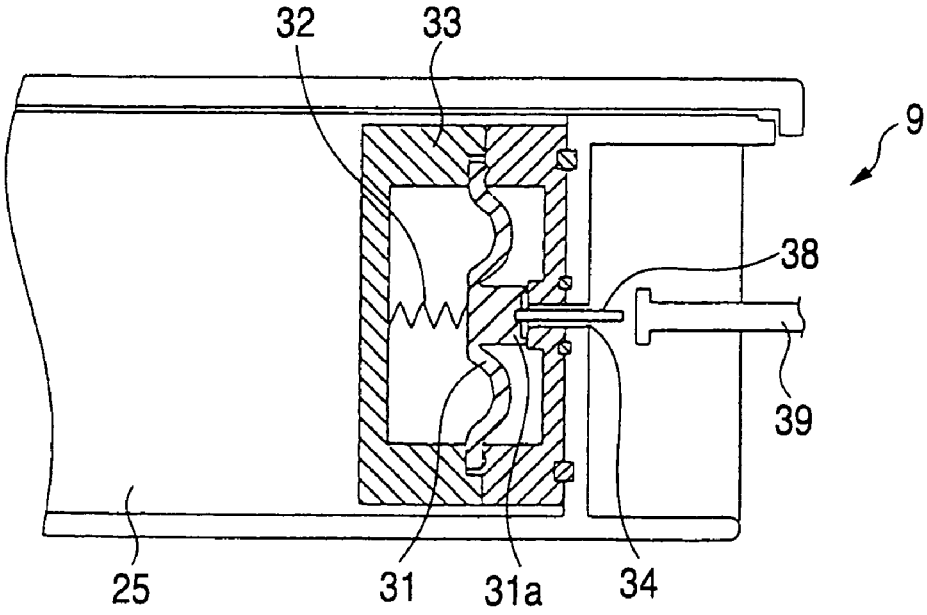

Further, as shown in FIG. 6, in case that an operation rod 38 which makes operation from the outside possible is arranged at the convex portion 31*a* of the elastic pressure reception plate 31, if the apparatus stops in the pressurized state by an operational power source, by pressing the operation rod 38 by a drive means 39, the elastic pressure reception plate 31 is moved back forcedly and the pressurized air can be discharged.

Figure 7:
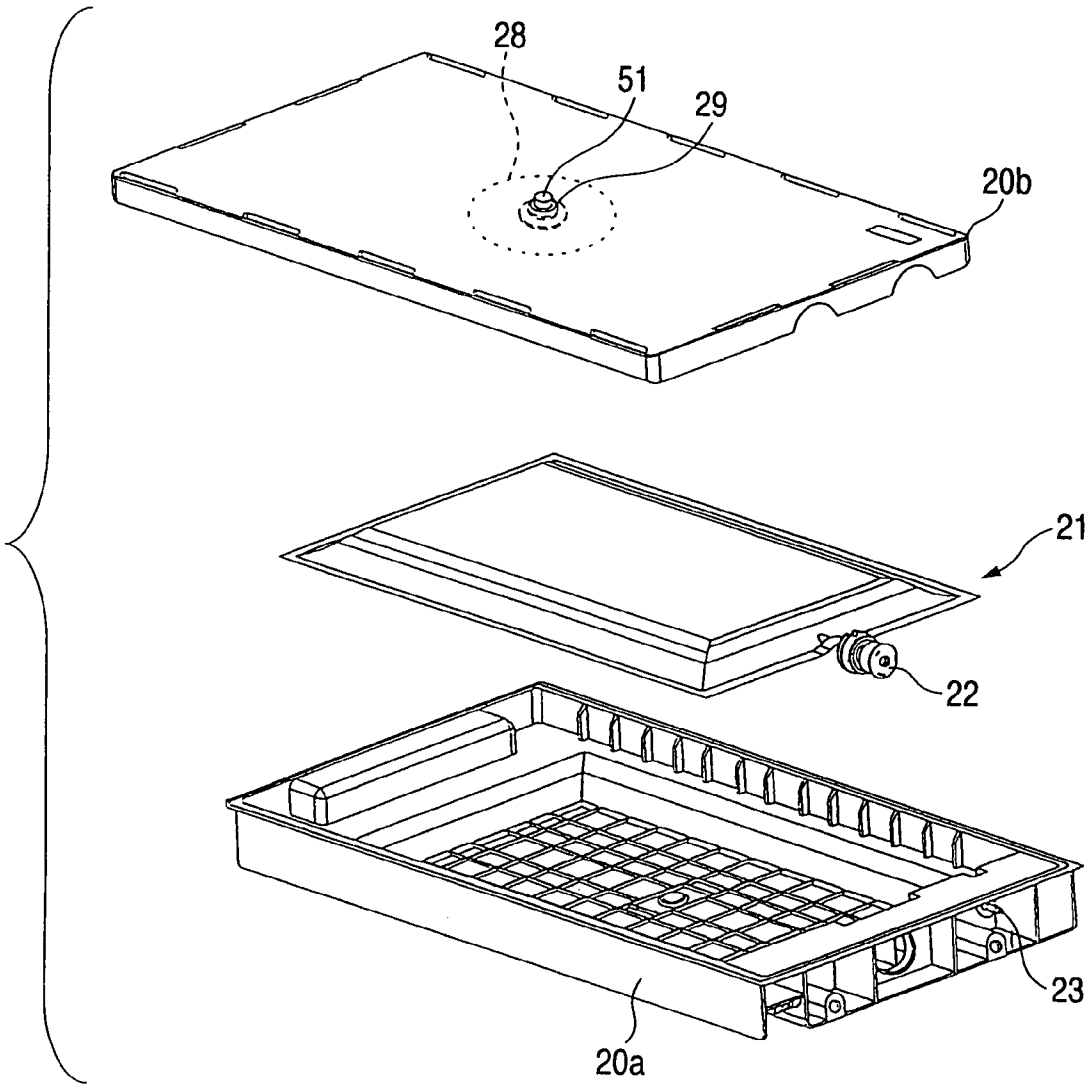
FIG. 7 is a perspective view in assembly showing another embodiment of the ink cartridge suitable for the recording apparatus.
Figure 8:
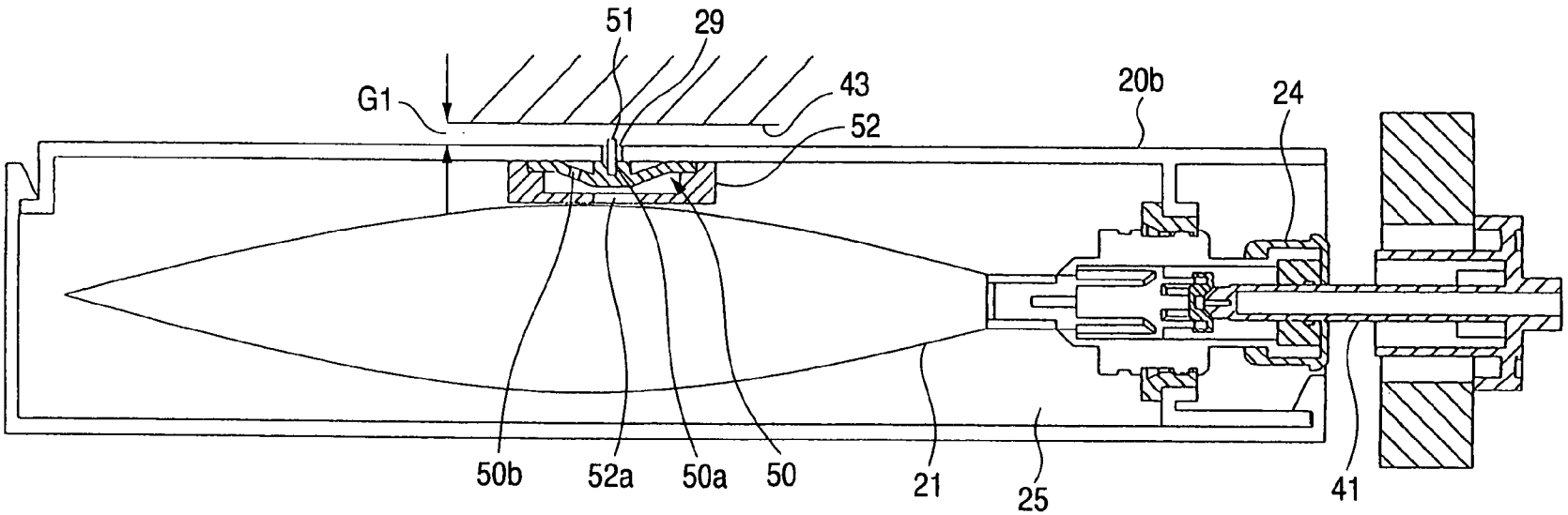
FIGS. 8 and 9 are sectional views respectively showing a valve closing state and a valve opening state in another embodiment of the ink cartridge of the invention.

FIGS. 7 and 8 show another embodiment of the ink cartridge of the invention. In this embodiment, an outer case 20 storing an ink pack 21 therein; a lid member 20*b* in this embodiment has an elastically deformable region 28, at a partial region, which is deformable so as to be risen by pressurized air. In its region 28, a through-hole 29 for outflow of pressurized air is formed, and an operation rod 51 of a valve member 50 described later is protruded from this through-hole 29 and freely fitted into the through-hole 29.

The valve member 50 includes a convex portion 50*a* that can seal the through-hole 29 at a region opposed to the through-hole 29. An urging unit; the valve member 50 in this embodiment is composed of an elastic member such as rubber, and displaces the convex portion 50*a* usually so as to come into contact with the through-hole 29. Surroundings of the valve member 50 are fixed by adhesive and a frame body 52, and the afore-mentioned operation rod 51 is provided for the convex portion 50*a*. Therefore, in this embodiment, the deforming region of the outer case 20, the valve member 50, and the operation rod 51 constitutes the afore-mentioned pressure adjusting unit.

On the other hand, a holder constituting the recording apparatus has, at a region opposed to the operation rod 51 in a state where the ink cartridge 9 is attached, a gap G1 which makes the elastic deformation of the outer case possible, and a partition wall 43 for receiving displacement of the operation rod 51.

In this embodiment, in case that pressure in a space 25 of the outer case 20 is below a regular value, as shown in FIG. 8, a leading end 51*a* of the operation rod 51 separates from the partition wall, and the through-hole 29 is sealed by the valve member 50.

Figure 9:
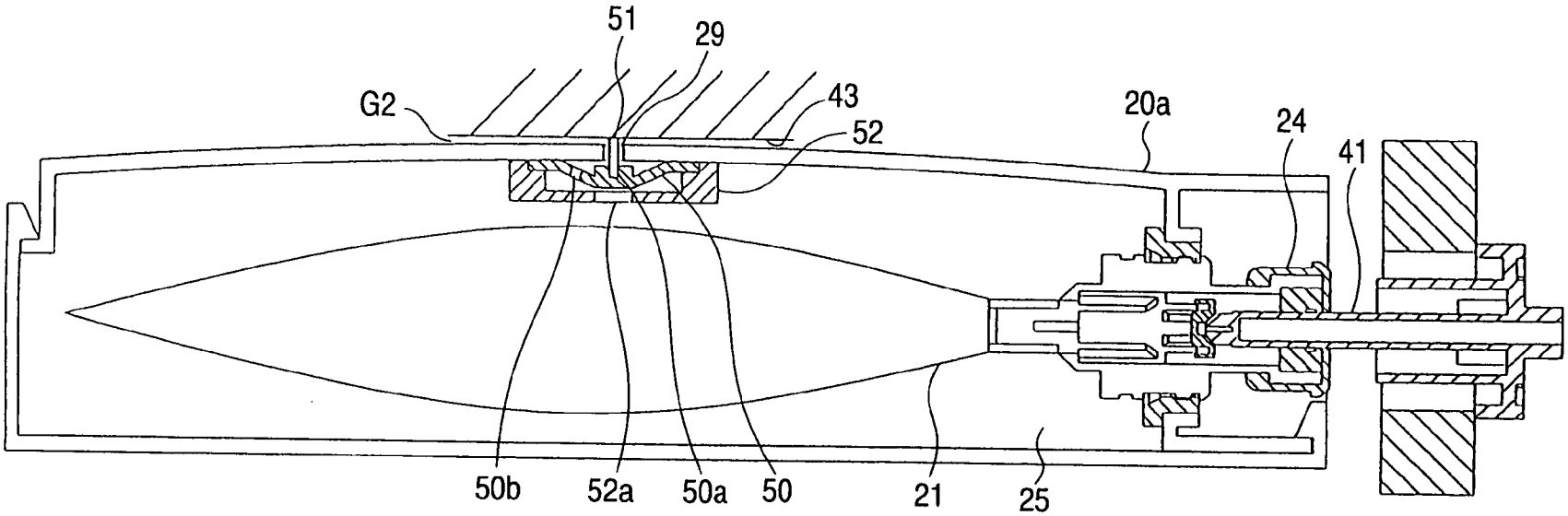

Therefore, pressurized air from air pumps 13B, 13C, 13M, and 13Y flows directly in the space 25 of the outer case 20 from a pressurized air inlet 23. When the pressure in the space 25 increases, the lid member 20*b* of the outer case 20 receives the air pressure correspondingly and expands outward. When the pressure in the space 25 of the outer case 20 increases over the pressure suitable to supply ink from the ink pack 21 to a sub-tank, as shown in FIG. 9, the outer case 20 expands and a gap G2 becomes small. Hereby, the operation rod 51 displaced as the outer case 20 expands comes into contact with the partition wall 43 of the holder, and is relatively pushed into. Hereby, the convex portion 50*a* of the valve member 50 separates from the through-hole 29, the space 25 is released to the atmosphere through the through-hole 29, a permeable pore 50*b*, and a permeable pore 52*a*, and a part of the pressurized air in the space flows out from the through-hole 29, so that the pressure in the outer case 20 decreases.

Expansion degree of the outer case is reduced by the decrease of pressure in the space 25, the operation rod 51 separates from the partition wall 43, and the valve member 50 seals the through-hole 29. Sequentially, the pressure in the space 25 is detected as displacement of the outer case 20, and the valve member 50 is connected to or disconnected from the through-hole 29 according to this displacement, whereby the pressure in the space 25 of the outer case 20 is kept at pressure suitable for ink supply.

In this embodiment, the valve member 50 is arranged at the region which can deform elastically. However, incase that a link mechanism such as a lever is coupled to the operation rod 51 to transmit the displacement of the operation rod 51 to another portion, the valve 50 can be arranged in another position. Further, though the outer case 20 is so constituted so that it can deform elastically, also in case that a window is formed in the outer case 20 and this window is sealed with an elastic plate, the similar effect is obtained.

According to these embodiments, even if pressure of pressurized air from the air pumps 13B, 13C, 13M, 13Y varies, the pressure is adjusted to air pressure suitable for each cartridge by the pressure adjusting unit of each cartridge, and it can be readjusted by the pressure adjusting unit according to difference in height among the ink cartridges and length of the ink supply tube, so that unevenness and fluctuation in ink current due to the pressure from the pump or the like can be reduced. Further, even if there is difference between the ink cartridges in capacity of the inner space made by the ink pack and the outer case, for example, in case that there is difference in ink capacity, since the optimum air pressure can be set, the various kinds of cartridges can be attached.

The regular value of the pressure adjusting unit can be adjusted by appropriately adjusting elasticity of the elastic pressure reception plate 31 and the urging force of the urging unit 32.

In the above embodiments, regardless of the amount of remaining ink in the ink pack, the ink pack is pressurized at a constant pressure. However, the pressing force may be changed according to the ink remaining amount.

Figure 10:
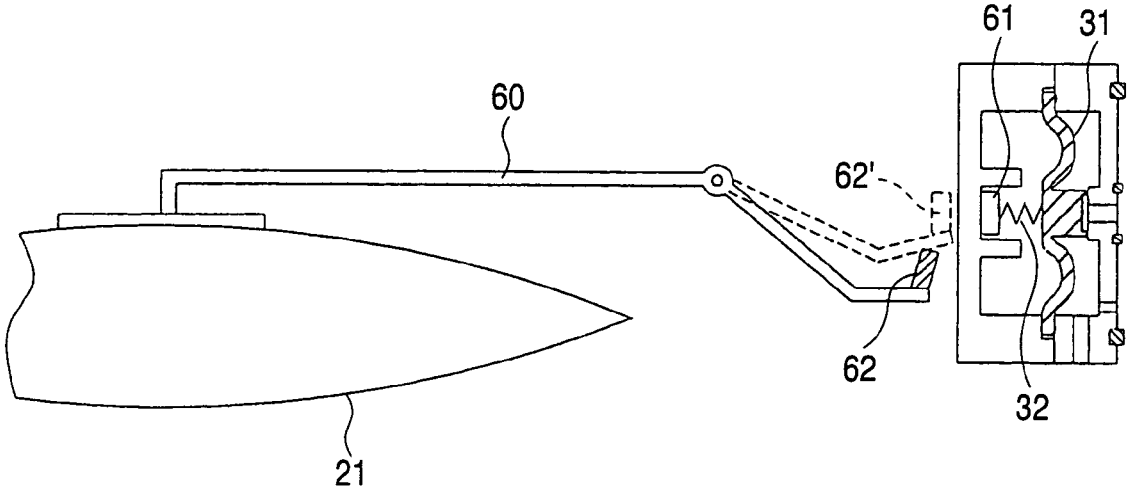
FIG. 10 is a sectional view of a pressure adjusting unit suitable for the ink cartridge of the invention in another embodiment.

Namely, in an embodiment of an ink cartridge shown in FIG. 10, a pressure adjusting unit is so constituted as to change the above pressing force. In this embodiment, volume of ink pack, that is, the amount of remaining ink is detected by a detection plate 60, and pressing force of an elastic press reception plate 31 is changed according to the displacement of the detection plate 60.

Namely, a first permanent magnet 61 is attached on the backside of the elastic pressure reception plate 31, and a second permanent magnet 62 is attached at a leading end of the detection plate 60.

According to this embodiment, in case that the ink remaining amount becomes small and relatively the pressing force decreases, the detection plate 60 is displaced, the second permanent magnet 62 attached to this detection plate 60 approaches the magnet 61 of the elastic pressure reception plate 31 as shown by reference numeral 62' in FIG. 10. Hereby, repulsion force becomes strong between the two magnets and the permanent magnet 61 moves toward the elastic pressure reception plate 31, and the pressing force of the elastic pressure reception plate 31 through a spring 32 increases, so that pressure in a space of an outer case 20 increases. Hereby, regardless of the remaining ink amount, ink can be supplied at a constant ink current, so that deterioration of printing quality caused by shortage of ink supply can be prevented and ink in the ink pack can be supplied to a recording head to the last.

As the mechanism which changes the pressing force of the diaphragm according to the volume of the ink pack 21, in addition to the magnetic force, there is constitution in which the spring 32 is biased on the diaphragm side by a coupling unit. The various mechanical design of this constitution can be easily assumed.

Figure 11A:
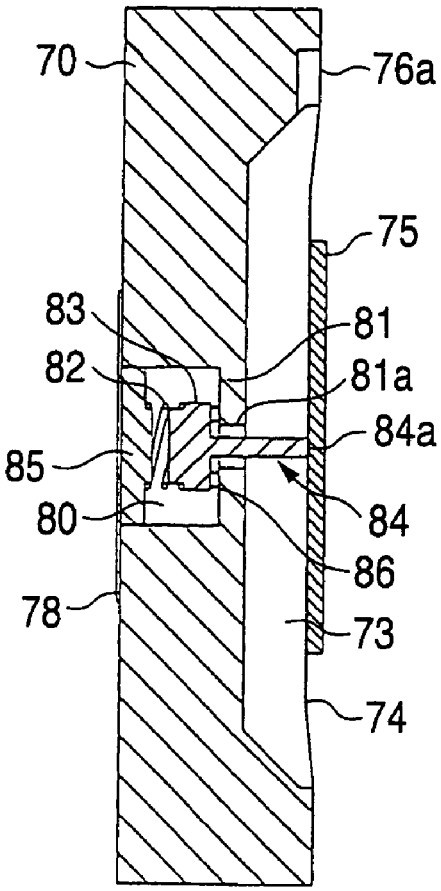
Figure 11B:
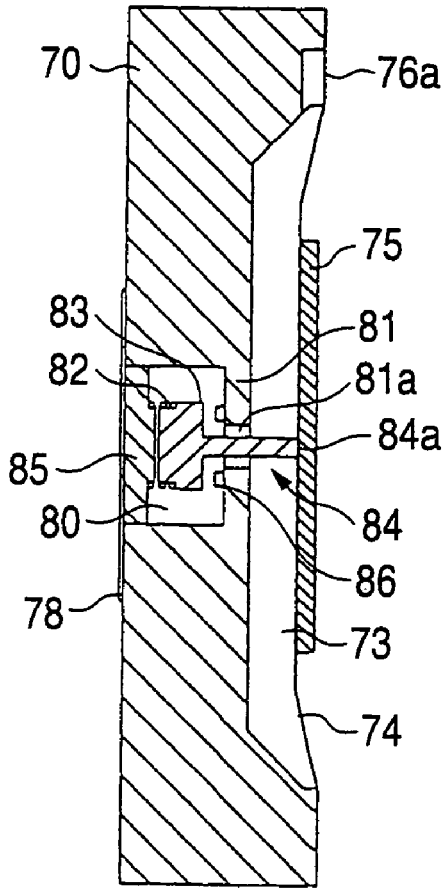
Figure 12A:
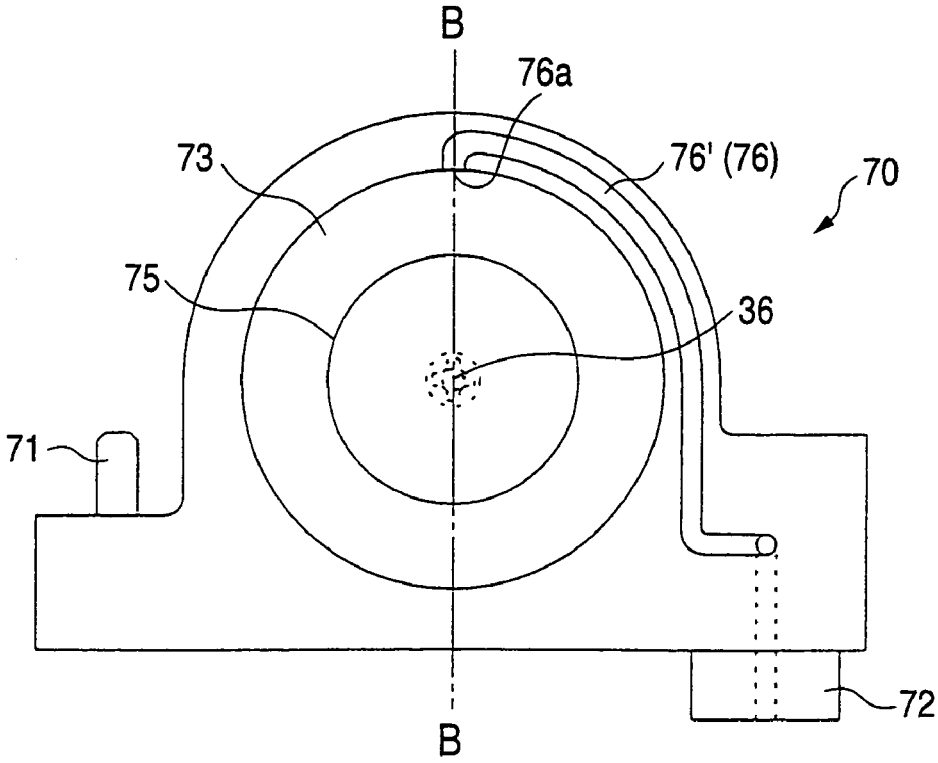
FIGS. 12A and 12B are front views showing the structure of a flowing passage constituting the sub-tank in the front and back structure of a base body.
Figure 12B:
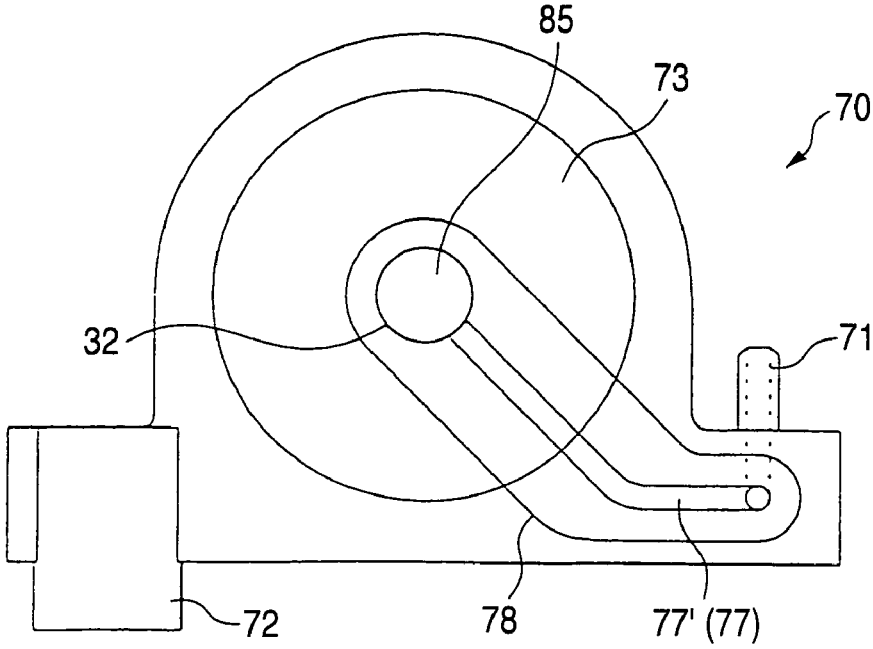

FIGS. 11A and 11B to 12A and 12B show one embodiment of the sub-tank used as an intermediate unit in case that ink in the ink cartridge is supplied to the recording head. As shown in FIGS. 12A and 12B, a base body 70 includes on its surface 10 an ink inlet 71 connected to the ink cartridge, and ink outlet 72 from which ink is supplied to the recording head. Further, the base body 70 includes in the center a recess portion 73' for forming an ink storing chamber 73. The ink storing chamber 73 is so structured that the recess portion 73' is sealed by a film 74 which can elastically deform according to pressure change due to ink consumption in the recording head. Further, the film 74, in order to efficiently transmit displacement of the film 74 to an operation rod described later, is provided with a backing material 75 made of plate in the center thereof so that an elastically deformable region leaves in circumference of the film 74 annularly, whereby rigidity is heightened. In case that the film 74 is formed by injection molding, the region of the backing material 75 is formed thicker, whereby the backing material 75 can be constituted integrally with the film 74.

On the surface of this base body 70 where the recess portion 73' is formed, a groove 76' communicating with the ink outlet 72 is formed, and sealed by a film, i.e., the film 74 forming the ink storing chamber in this embodiment thereby to form an ink discharging passage 76. A communicating hole 76*a* of the ink discharging passage 76 with the ink storing chamber 73 is located at the top portion of the ink storing chamber 73 when the sub-tank is set.

Further, on a rear surface of the base body 70, as shown in FIG. 12B, a groove 77' forming an ink inflow passage 77 which communicates a valve housing chamber 80 with the ink inlet 71 is formed, and it is sealed by a film 78 thereby to form the ink inflow passage 77.

Reference numeral 80 is a valve housing chamber, in which a recess portion 80' is formed so as to make a dorsiventral relation by the ink storing chamber 73 and a partition wall 82. In the recess portion 80', a valve member 83 which is usually pressed toward the partition wall 81 by an urging means 82, a coil spring in this embodiment is housed. In the center portion of the valve member 83, an operation rod 84 which passes through a communicating hole 81*a* formed in the partition wall 81 is provided, and its leading end 84*a* comes into contact with the film 74.

Reference numeral 85 represents a lid member for seal, and reference numeral 86 is a ring-shaped elastic seal member which is arranged around the communicating hole 81*a* and with which the valve member comes into contact.

In this embodiment, when the recording head is sealed by a capping means to apply absorption force to the recording head, negative pressure acts on the ink storing chamber 73, and the film 74 is displaced on the valve housing chamber 80 side (to the left in the figure) as shown in FIG. 11B. Hereby, the operation rod 84 separates from the communicating hole 81*a* against the urging force of the urging means 82, and the flowing passage from the recording head to the ink cartridge enters a communicating state, so that ink in the ink cartridge flows through the valve housing chamber 80, the communicating hole 81*a*, and the ink storing chamber 73 into the recording head.

In this process, air bubbles in the flowing passage also flow into the ink storing chamber 73, move to the top portion by buoyancy, and are sucked out by the recording head through a communicating hole 76*a* located at this top portion thereby to be discharged to the outside.

When ink filling in the recording head is thus completed, in case that the capping unit is taken off from the recording head, the film 74 is pressed through the operation rod 84 by the urging unit 82 and displaced outward, so that the valve member 83 seals the communicating hole 81*a*.

When printing is executed under this state and ink is consumed by the recording head, ink in the ink storing chamber 73 flows into the recording head. Since the communicating hole 81*a* is sealed by the valve member 83 in the present state, the ink in the ink storing chamber 73 is supplied while the film 74 is being displaced on the valve housing chamber side. When the pressure in the ink storing chamber 73 becomes lower than the set pressure by the urging unit 82, the operation rod 84 is pressed by the displacement of the film 74 against the urging force of the urging unit 82 and separates from the communicating hole 81*a*. Hereby, as described before, the ink in the ink cartridge flows into the ink storing chamber 73 through the valve housing chamber 80, the pressure in the ink storing chamber 73 increases, and the film 74 moves outward. When the pressure in the ink storing chamber 73 thus becomes the regular negative pressure, the valve member 83 seals the communicating hole 81*a* thereby to stop ink supply to the ink storing chamber 73.

Sequentially, every time the pressure in the ink storing chamber 73 lowers below the predetermined value due to ink consumption in the recording head, the above steps are repeated, and ink is supplied to the recording head while ink is kept at the constant negative pressure.

Since the valve opening pressure of the valve member is set by the urging unit 82 composed of the spring, regardless of posture of sub-tank, and regardless of inertial force due to the movement of carriage, the ink can be supplied to the recording head while the negative pressure state is being kept.

INDUSTRIAL APPLICABILITY

As described above, according to the invention, the setting value of the pressure adjusting unit is set to an optimum value for each ink cartridge, whereby ink can be supplied to the recording head in an optimum state regardless of fluid resistance of the ink supply passage from the ink cartridge to the recording head, and regardless of difference in height between the ink cartridges, so that printing having high quality can be performed.

What is claimed is:

1. A sub-tank comprising:

an ink inlet for receiving ink;

an ink outlet for supplying ink;

an ink storage chamber connected to said ink outlet;

a valve housing chamber connected to said ink inlet;

a valve disposed in said valve housing chamber;

a partition wall provided between said ink storage chamber and said valve housing chamber, and formed with a communicating hole communicating with said ink storage chamber and said valve housing chamber; and an urging unit disposed in said valve housing chamber and urging said valve toward said partition wall wherein when a pressure in the ink storage chamber is above a predetermined value, said valve is brought into contact with said partition wall and seals said communicating hole; and wherein when the pressure in the ink storage chamber is below a predetermined value, said valve is seperated from said partition wall and opens said communicating hole, so that ink flows through said communicating hole from said valve housing chamber to said ink storage chamber.

2. The sub-tank according to claim 1, wherein said partition wall has a rigidity so that said urging unit urges said valve toward said partition wall to seal said communicating hole.

3. The sub-tank according to claim 1, wherein said ink storing chamber is so constructed that a recess portion is sealed by a film which can elastically deform according to pressure change in said ink storage chamber.

4. The sub-tank according to claim 1, further comprising operation rod attached to said valve and protruding from said communicating hole;

wherein when the pressure in the ink storage chamber is below the predetermined value, a portion of said ink storage chamber presses against said operation rod to move said valve to a position where said valve does not seal said communicating hole.

5. The sub-tank according to claim 4, wherein a backing material is provided at the portion of said ink storage chamber that presses against said operation rod.

* * * * *

UNITED STATES PATENT AND TRADEMARK OFFICE

CERTIFICATE OF CORRECTION

PATENT NO. : 7,506,972 B2
APPLICATION NO. : 11/443128
DATED : March 24, 2009
INVENTOR(S) : Yoshiharu Aruga It is certified that error appears in the above-identified patent and that said Letters Patent is hereby corrected as shown below:

On the title page item (45) before Mar. 24, 2009 insert (*)

(73) Assignee: Seiko Epson Corporation, Tokyo (JP)

(*) Notice: Subject to any disclaimer, the term of this patent is extend or adjusted under 35 U.S.C. 154(b) by 336 days.

<u>This patent is subject to a terminal disclaimer.</u>

Signed and Sealed this

Thirteenth Day of October, 2009

David J. Kappos

David J. Kappos
*Director of the United States Patent and Trademark Office*